US009366002B2

(12) United States Patent
Liu et al.

(10) Patent No.: US 9,366,002 B2
(45) Date of Patent: Jun. 14, 2016

(54) CONNECTION STRUCTURE FOR BLOCKING SETTLEMENT OF GROUND

(71) Applicant: HYDROCHINA HUADONG ENGINEERING CORPORATION LIMITED, Hangzhou, Zhejiang Province (CN)

(72) Inventors: Shiming Liu, Hangzhou (CN); Shengtian Xia, Hangzhou (CN)

(73) Assignee: HYDROCHINA HUADONG ENGINEERING CORPORATION LIMITED (CN)

( * ) Notice: Subject to any disclaimer, the term of this patent is extended or adjusted under 35 U.S.C. 154(b) by 0 days.

(21) Appl. No.: 14/641,390

(22) Filed: Mar. 8, 2015

(65) Prior Publication Data

US 2015/0299978 A1 Oct. 22, 2015

(30) Foreign Application Priority Data

Apr. 18, 2014 (CN) ..... 2014 1 0155669

(51) Int. Cl.

| | |
|---|---|
| ***E02D 27/50*** | (2006.01) |
| ***E02D 31/08*** | (2006.01) |
| ***E02D 27/14*** | (2006.01) |
| ***E02D 27/16*** | (2006.01) |
| ***E02D 31/00*** | (2006.01) |
| ***E02D 37/00*** | (2006.01) |
| ***E04B 1/38*** | (2006.01) |
| ***E04B 1/98*** | (2006.01) |

(52) U.S. Cl.

CPC ..... *E02D 31/08* (2013.01); *E02D 27/14* (2013.01); *E02D 27/16* (2013.01); *E02D 27/50* (2013.01); *E02D 31/00* (2013.01); *E02D 37/00* (2013.01); *E04B 1/38* (2013.01); *E04B 1/985* (2013.01)

(58) Field of Classification Search

CPC ..... E02D 31/00; E02D 31/08; E02D 27/14; E02D 27/16; E02D 27/50

See application file for complete search history.

(56) References Cited

U.S. PATENT DOCUMENTS

2008/0304921 A1* 12/2008 Langley ..... E02D 31/00 405/270
2013/0125481 A1* 5/2013 Marshall ..... E02D 31/00 52/169.14

* cited by examiner

*Primary Examiner* — Tara M. Pinnock
(74) *Attorney, Agent, or Firm* — PROI Intellectual Property US

(57) ABSTRACT

The present invention discloses a connection structure for use in a building for blocking settlement of ground from being transmitted to either a pile foundation or a wall of the building. The connection structure comprises a weight-bearing column, a concrete pile foundation, and an engineering pile connected from top to bottom for bearing weight; the connection structure further comprises a reinforced concrete plate for use as the building's floor, a wall for the building and a ground beam beneath the wall.

6 Claims, 6 Drawing Sheets

CONNECTION STRUCTURE FOR BLOCKING SETTLEMENT OF GROUND

CROSS REFERENCE TO RELATED APPLICATIONS

The present application claims priority of China Patent Application No. 2014 101 556 69.8, filed on Apr. 18, 2014, the entirety of which is incorporated by reference herein.

TECHNICAL FIELD

The present invention relates to a connection structure for use in a building; the connection structure is useful for blocking settlement of ground from being transmitted to either a pile foundation or a wall of the building. The connection structure is suitable for use at locations in buildings where there is stress and/or settlement transmission between floor and pile foundation, between floor and floor, and between floor and wall of the building. The connection structure is especially suitable for use in buildings built on thick soft soil layers.

BACKGROUND OF THE INVENTION

During the past several decades, many kinds of industrial buildings were built all over the country along with the ongoing economy development in China. Most of the industrial buildings are of 2 to 3 storied steel structure buildings, in the process of using, large loads from cranes are transmitted by crane beams to load-bearing columns or walls, which usually are supported by pile foundations and then settlements are small. Meanwhile, the floors of these buildings are usually designed as passageways, working or temporary storage areas, and the foundations of the floors are natural foundations without treatment in consideration of investment saving. Such buildings are built on soft soil layers in Ningbo, Wenzhou, Taizhou. And these buildings are suffering settlements of the indoor ground because of the effects of the loads from the usual storages and shipping carts, while the columns and walls for bearing the load of building structure and crane beam have relatively little settlement because of the pile foundations. Therefore, an obvious settlement difference occurs between the floor of the building and the pile foundation or wall of the building, and if the connection structure between the floor and pile foundation or wall was treated improperly, structure cracks in the floor or the unevenness of the floor would occur, which would lead the damage of the working environment, or even worse, like the stop-working of the shipping machine. Thus it is urgent to solve the connection problem between the floor and the pile or wall in the industrial buildings.

SUMMARY

To solve the problem mentioned above, the present invention proposes a connection structure for use in a building for blocking settlement of ground from being transmitted to either a pile foundation or a wall of the building. The connection structure can block the transmission of stress and/or settlement of ground between column and floor, between wall and floor, and/or between floor and floor of the building. Using such connection structure, differential settlement of the floor can be avoided, the floor can be kept even, and a good working environment can be created.

The technical solution provided by this invention is a connection structure for use in a building for blocking settlement of ground from being transmitted to either a pile foundation or a wall of the building. The connection structure comprises a weight-bearing column, a concrete pile foundation, and an engineering pile connected from top to bottom for bearing weight; the connection structure further comprises a reinforced concrete plate for use as the building's floor, a wall for the building and a ground beam beneath the wall. The concrete pile foundation is surrounded by a brick wall wherein a first foam sheet is placed between the concrete pile foundation and the brick wall. A top part of the brick wall is connected to the reinforced concrete floor. A bottom part of the brick wall is placed on a first cushion layer made of plain concrete. A space for accommodating settlement is reserved between a top surface of the concrete pile foundation and the reinforced concrete plate. A second foam sheet is placed between the reinforced concrete plate and the vertically connected building wall. A bottom part of the ground beam is placed on a second cushion layer made of plain concrete. A third foam sheet is placed between two adjacent reinforced concrete plates, and a third cushion layer made of plain concrete is placed below the two adjacent reinforced concrete plates. A fourth foam sheet is placed between the reinforced concrete plate and a foundation for a rail for use in the building, and a fourth cushion layer made of plain concrete is placed below the foundation for the rail.

Preferably, all the cushion layers made of plain concrete may extend outwardly by 100 mm from the edges of the structures arranged immediately above said cushion layers.

Preferably, at the joint between the reinforced concrete plate and the building wall, a layer of mixture of weathered stone and/or soil may be placed under the reinforced concrete plate.

Preferably, at the joint between two adjacent reinforced concrete plates (4), two layers of asphalt felt (9) may be placed beneath the two adjacent reinforced concrete plates (4) and the third foam sheet, and/or, at the joints between the fourth reinforced concrete plate (4) and the foundation (10) for the rail, two layers of asphalt felt (9) may be placed beneath the fourth reinforced concrete plate and the fourth foam sheet.

Preferably, at the joint between two adjacent reinforced concrete plates and/or at the joint between the reinforced concrete plate and the foundation for the rail, two layers of asphalt felt (9) may be placed beneath the reinforced concrete plate.

Preferably, the thickness of the brick wall may be 240 mm, and the thickness of the foam sheet may be 50 mm.

The advantages of this invention include the following: Due to the settlement blocking effect of foam sheets at possible locations where there may be stress and/or floor settlement transmission, and due to the measures assisting this effect, this invention can effectively block the stress and floor settlement transmission between column and floor, between wall and floor, and between two adjacent floors in buildings, as proven by tests. Further, this invention can avoid differential settlement of the floor, keep the floor even and create a good working environment

DETAILED DESCRIPTION OF THE PREFERRED EMBODIMENTS

Figure 1:
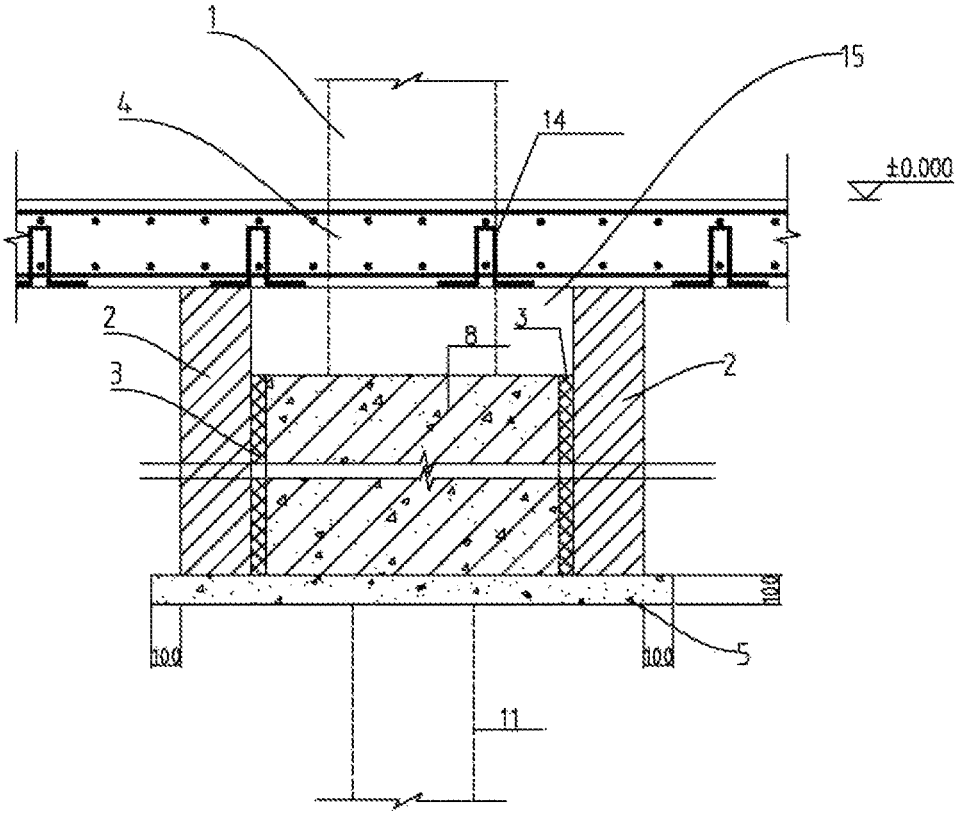
FIGS. 1, 2, and 3 show structures connecting a reinforced concrete plate and a column foundation.

According to one embodiment of the invention, a connection structure for use in a building for blocking settlement of ground from being transmitted to either a pile foundation or a wall of the building comprises a rectangular weight-bearing column (1), a concrete pile foundation (8), and an engineering pile (11) connected from top to bottom for bearing weight, a reinforced concrete plate (4) for use as the building's floor, a wall (6) for the building and a ground beam (7) beneath the wall (6).

Figure 2:
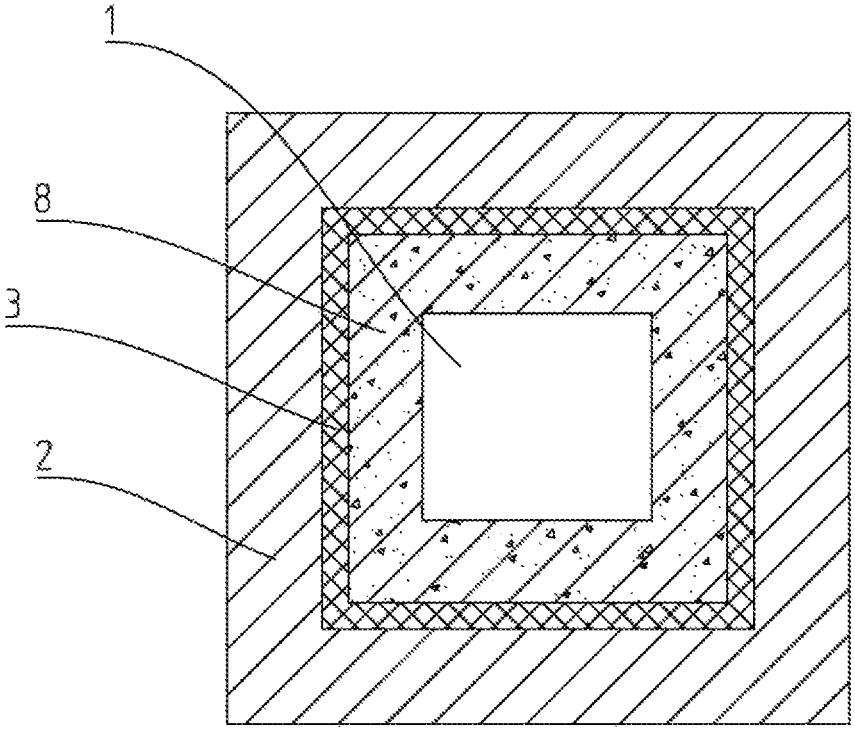
Figure 3:
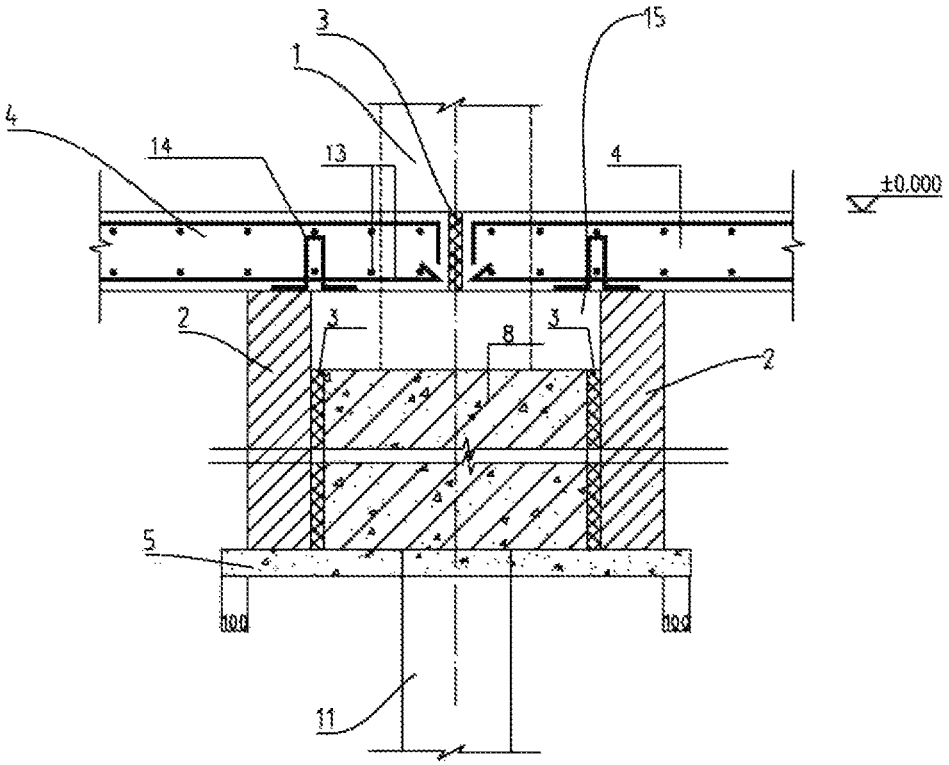

As shown in FIGS. 1 to 3, a brick wall (2) with a thickness of 240 mm is built around the concrete pile foundation (8) and a foam sheet (3) with a thickness of 50 mm is placed between the brick wall and the concrete pile foundation. Due to this arrangement, a displacement is allowed between the brick wall and the concrete pile foundation; in other words, the brick wall is allowed to move relative to the concrete pile foundation. The top of brick wall (2) is connected to the reinforced concrete plate (4), and a cushion layer made of plain concrete (5), which is parallel to the reinforced concrete plate (4), is arranged at the bottom of the brick wall (2). For accommodating the settlement of the ground, a space (15) is reserved between the top surface of the concrete pile foundation (8) and the reinforced concrete plate (4). The size of this settlement space is determined according to settlement calculation and experience.

Figure 4:
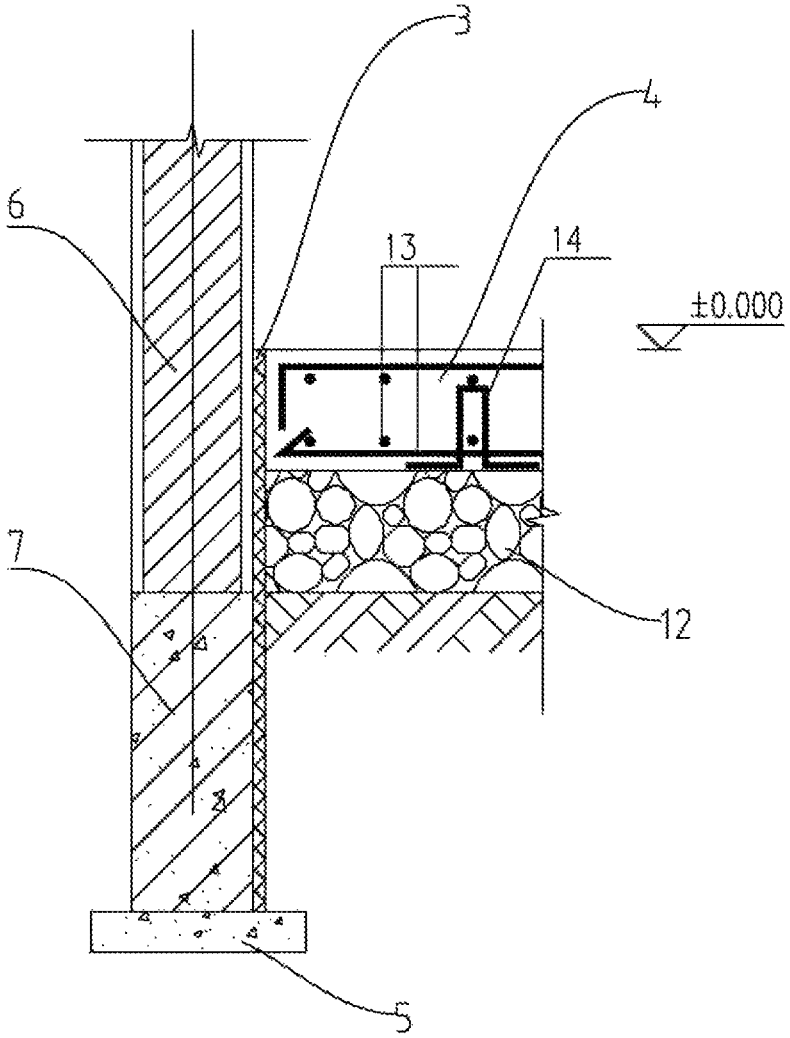
FIG. 4 shows a structure connecting a reinforced concrete plate and a wall.

As shown in FIG. 4, at the location where the reinforced concrete plate (4) is adjacent to the building wall (6) (a ground beam (7) is placed beneath the wall), a second foam sheet (3) with a thickness of 50 mm is placed between the reinforced concrete plate (4) and the vertically connected building wall (6). When settlement of the reinforced concrete plate occurs, a displacement of the reinforced concrete plate relative to the wall (6) is allowed. Similarly, a cushion layer made of plain concrete (5) is arranged beneath the bottom of the ground beam (7), and a layer of mixture of weathered stone and/or soil (12) is placed between the reinforced concrete plate (4) and the ground.

Figure 5:
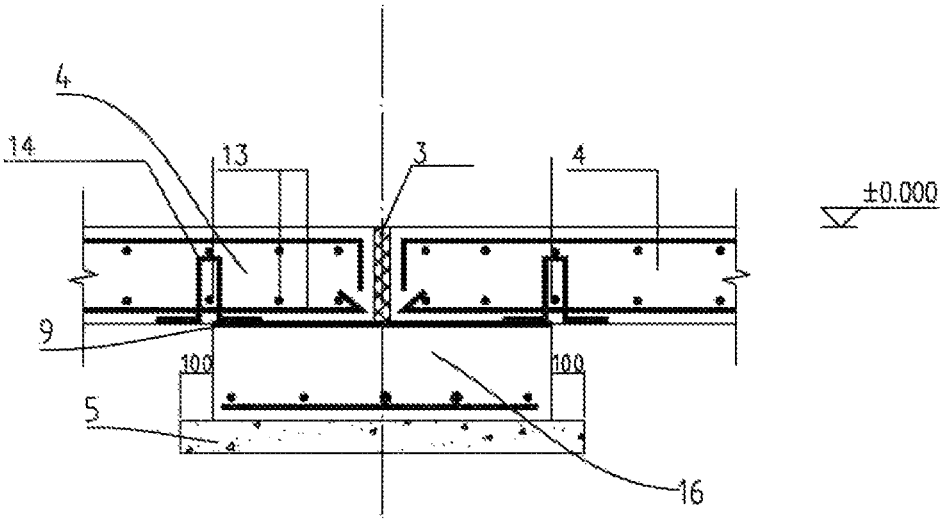
FIG. 5 shows a structure connecting two adjacent reinforced concrete plates.

As shown in FIG. 5, when two adjacent reinforced concrete plates (4) splice, a third foam sheet with a thickness of 50 mm is placed between two adjacent reinforced concrete plates (4) and a third cushion layer made of plain concrete is placed below two adjacent reinforced concrete plates (4), A second stage concrete (16) is placed between the cushion layer and the reinforced concrete plates above.

Figure 6:
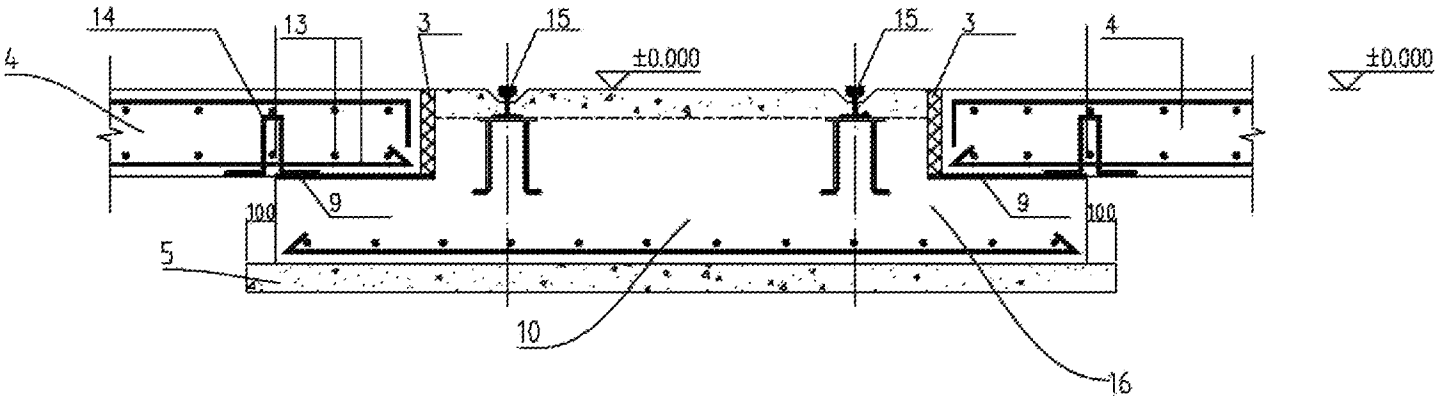
FIG. 6 shows a structure connecting a reinforced concrete plate and a foundation for a rail.

As shown in FIG. 6, a fourth foam sheet is placed between the reinforced concrete plate (4) and a foundation (10) for a rail for use in the building, and a fourth cushion layer made of plain concrete (5) is placed below the foundation (10) for the rail. In the upper part of the concrete of the foundation (10) for rail a ground rail base (15) is installed. In the second stage concrete (16) of the foundation (10) for rail (above the plain concrete cushion layer (5)), Model Π anchor steels are assembled.

All the cushion layers made of plain concrete (5) may extend 100 mm from the edges of the structures arranged immediately above the cushion layers. In this way, when the settlement of the building ground is large, the cushion layers can be easily sheared off into the subsoil, avoiding adverse influence to the concrete pile foundation or the building wall, and thus blocking settlement transmission and keeping the building floor even.

As shown in FIGS. 5 and 6, at the horizontal joints, two layers of asphalt felt (9) are placed between the reinforced concrete plate and the second stage concrete.

Preferably, the thickness of the reinforced concrete plate (4) is not less than 300 mm and the reinforced concrete plate is reinforced with steel bars, such as round steel bars (13) and/or U-shaped steel bars (14). Preferably, the length and width of the reinforced concrete plate are not more than 100 meters. The above measures can be adopted in order to adjust the stress of the reinforced concrete plate effectively, to control the differential settlement, and to avoid cracks from occurring in the reinforced concrete plate.

When the ground of the building (usually with reinforced concrete plate and foundation for rail) on weak subsoil layer suffers from settlement, due to the blocking effect of the foam sheet between the weight-bearing columns or the surrounding walls (with little settlement) and the floor of large area, and beneath the bottom of the floor, cushion layers made of plain concrete are placed, the ground settlement becomes an isolated movement, which causes no unevenness of the floor or cracks in the floor even when the bottom of the load-bearing column is higher than the floor surface.

The invention claimed is:

1. A connection structure for use in a building for blocking settlement of ground from being transmitted to either a pile foundation or a wall of the building, said connection structure comprising a weight-bearing column, a concrete pile foundation, and an engineering pile connected from top to bottom for bearing weight; said connection structure further comprising a reinforced concrete plate for use as the building's floor, a wall for the building and a ground beam beneath the wall; wherein said concrete pile foundation is surrounded by a brick wall wherein a first foam sheet is placed between said concrete pile foundation and said brick wall;

a top part of the brick wall is connected to the reinforced concrete floor, and a bottom part of the brick wall is placed on a first cushion layer made of plain concrete;

a space for accommodating settlement is reserved between a top surface of the concrete pile foundation and the reinforced concrete plate;

a second foam sheet is placed between the reinforced concrete plate and the vertically connected building wall;

a bottom part of the ground beam is placed on a second cushion layer made of plain concrete;

a third foam sheet is placed between two adjacent reinforced concrete plates, and a third cushion layer made of plain concrete is placed below the two adjacent reinforced concrete plates; and a fourth foam sheet is placed between the reinforced concrete plate and a foundation for a rail for use in the building, and a fourth cushion layer made of plain concrete is placed below the foundation for the rail.

2. The connection structure of claim 1, wherein all the said cushion layers of plain concrete extend outwardly 100 mm from the edges of structures arranged immediately above said cushion layers of plain concrete.

3. The connection structure of claim 2, wherein a layer of mixture of weathered stone and/or soil is placed under the reinforced concrete plate.

4. The connection structure of claim 1, wherein a layer of mixture of weathered stone and/or soil is placed under the reinforced concrete plate.

5. The connection structure of claim 1, wherein at the joints between said two adjacent reinforced concrete plates or between the reinforced concrete and the foundation, two asphalt felt layers are placed beneath the reinforced concrete plates and the third foam sheet, or wherein at the joints between the fourth reinforced concrete plate and the foundation for the rail, two asphalt felt layers are placed beneath the fourth reinforced concrete plate and the fourth foam sheet.

6. The connection structure of claim 1, wherein a thickness of the brick wall is 240 mm and a thickness of the foam sheets is 50 mm.

* * * * *